US007257864B2

(12) United States Patent
Liang et al.

(10) Patent No.: US 7,257,864 B2
(45) Date of Patent: Aug. 21, 2007

(54) CASEMENT WINDOW HINGE

(76) Inventors: Luke K. Liang, 30 Spruce Hollow Rd., Green Brook, NJ (US) 08812; Tong Liang, 195 Yan Jiang Center Road, Suite 1712, Guangzhou (CN) 510115

( * ) Notice: Subject to any disclaimer, the term of this patent is extended or adjusted under 35 U.S.C. 154(b) by 64 days.

(21) Appl. No.: 10/308,203

(22) Filed: Dec. 2, 2002

(65) Prior Publication Data

US 2005/0055804 A1 Mar. 17, 2005

(51) Int. Cl.
*E05D 3/06* (2006.01)

(52) U.S. Cl. ..... 16/366; 16/239; 16/242

(58) Field of Classification Search ..... 16/366, 16/235, 239–242, 362, 368, 354; 49/336–335, 49/250–252, 396, 246
See application file for complete search history.

(56) References Cited

U.S. PATENT DOCUMENTS

| | | | | | |
|---|---|---|---|---|---|
| 4,790,106 | A * | 12/1988 | La See | 49/252 |
| 5,040,267 | A * | 8/1991 | Dallmann | 16/239 |
| 5,074,075 | A * | 12/1991 | La See | 49/252 |
| 5,289,656 | A * | 3/1994 | Vetter | 49/250 |
| 5,491,930 | A * | 2/1996 | La See | 49/252 |
| 5,882,061 | A * | 3/1999 | Guillouet | 296/65.05 |
| 5,961,011 | A * | 10/1999 | Thomas et al. | 222/541.6 |
| 6,112,371 | A * | 9/2000 | Tremblay | 16/362 |
| 6,134,751 | A * | 10/2000 | Carrier et al. | 16/242 |
| 6,442,899 | B1 | 9/2002 | Gledhill | |
| 6,513,194 | B2 * | 2/2003 | Harkins et al. | 16/239 |
| 2002/0078528 | A1 * | 6/2002 | Gledhill | 16/362 |

FOREIGN PATENT DOCUMENTS

| | | | |
|---|---|---|---|
| DE | 2115323 | B * | 9/1975 |
| DE | 2617230 | A * | 11/1976 |
| DE | 3738596 | A * | 6/1989 |
| DE | 19650866 | A1 * | 6/1998 |
| EP | 404348 | A * | 12/1990 |
| EP | 1132559 | A1 * | 9/2001 |

* cited by examiner

*Primary Examiner*—Chuck Y. Mah
(74) *Attorney, Agent, or Firm*—Thomas A. O'Rourke; Bodner & O'Rourke, LLP

(57) ABSTRACT

An improved shoe for a casement window hinge is disclosed. The hinge has a base with a front end and a rear end and two sides. The base has a ridge on the rear end for securing the base to a track and a tongue extending from one of the sides. The tongue has a plurality of teeth extending from a side of the tongue. A gear wheel is adapted to be rotatably secured to a track. The gear wheel has a plurality of teeth about its circumference which mesh with the teeth on the tongue. The rotation of the gear wheel causes the base of the hinge to move longitudinally in relation to the track.

23 Claims, 9 Drawing Sheets

C — C

B — B

A — A

B

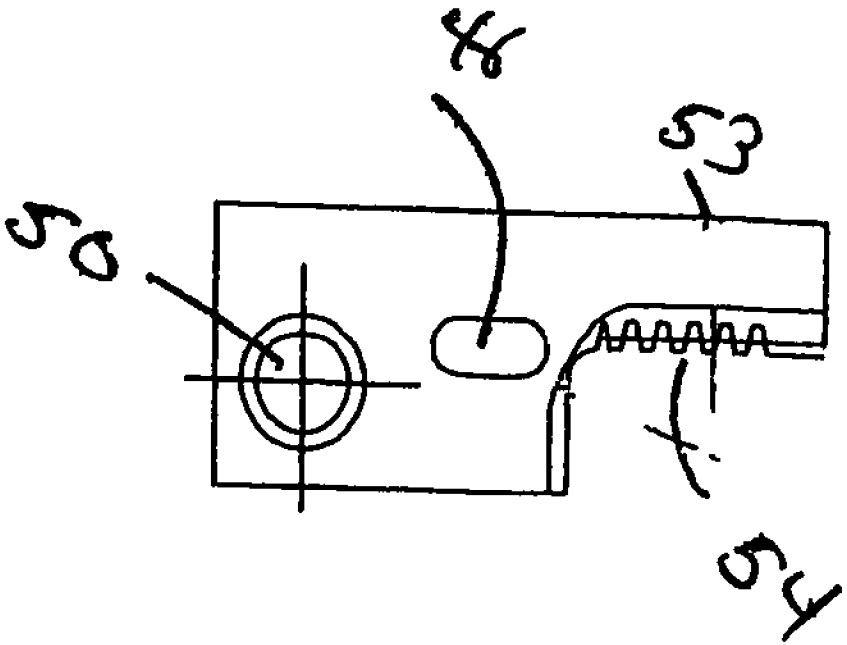
A Figure 13
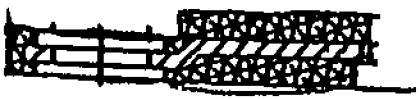
A Figure 11

CASEMENT WINDOW HINGE

FIELD OF THE INVENTION

The present invention is directed to hinges for casement windows and more particularly, improvements in the adjustability of such hinges.

BACKGROUND OF THE INVENTION

In most construction there are a variety of window types that are available. These windows may include fixed, double hung, casement, transom, etc. Each window has certain benefits and drawbacks. Fixed windows for example are not able to be opened for ventilation. Double hung windows were originally designed to let cooler air in the lower portion and hotter air out the upper portion. Casement windows are advantageous in that the entire window can open.

Traditional double hung windows ride in a track and are raised and lowered for ventilation. Casement windows are windows that are mounted in a frame and are hingedly connected on one side to a frame, or to the top and bottom, by usually a pair of hinges. Casement windows typically open outwardly, although, there are some casement type windows that open inwardly instead. The pair of hinges that connect a casement window to a frame are usually situated at the tops and bottoms of the windows. The hinges have a track mounted to the window frame and a sash arm connected to the window. The sash arm is connected to the track by a support arm. The support arm is usually pivotally connected to both the track and the sash arm. The sash arm is also pivotally connected to a mounting shoe, which is supported and guided during movement by the track. Another type of hinge mechanism for casement windows has a link between the sash arm and the movable shoe to offset the sash arm.

The hinge mechanism in casement windows is subject to stress over time. There is a risk that the window may become misaligned whether through poor installation, the weight of the window, weathering or moisture or simply just settling of the house. The hinge mechanism has to compensate for these variations over time. In addition, the fixed track pivot must be properly located relative to the window sash. The fixed track pivot is usually positioned between the support arm and the window frame for proper operation of the window. One of the problems that may be encountered over time is the shifting of the fixed track pivot due to shifting of the window, the window frame, etc., which may result in sagging of the sash. In the event the sash sags, there is a risk that the window may not seal properly and permit moisture and cold air to enter. Another problem that may be caused by sagging of the sash is difficulty in opening and closing the window.

Prior art casement windows attempted to overcome problems with sagging of the sash by requiring precise installation of the hinge mechanism. Another approach has been to permit adjustment of the track to compensate for the sagging sash. In these windows, however, repeated adjustment of the track could result in the mounting assembly for the track undergoing fatigue and gradually loosening. In addition, to adjust the track of many casement windows the window must be open and it is difficult to determine whether the window will close satisfactorily when the adjustment is made. As a result, there is a need for the casement window hardware to be particularly strong and withstand the stresses of opening and closing these windows as well as the weight of the window and settling of the house.

As a result, there is a need for an improved hinge for casement windows which will permit the installer, repair person and/or home owner to adjust the hinge either during installation or later to compensate for sagging of the sash, frames being out of alignment, and other problems with the casement windows that made it difficult to install the windows or adjust their movement once they have been installed in a window.

OBJECTS OF THE INVENTION

It is an object of the invention to provide an improved hinge for casement windows.

It is also an object of the invention to provide a casement window hinge that is more adjustable than traditional hinges.

It is another object of the invention to provide a hinge for casement windows that is stronger than traditional casement window hinges.

It is still another object of the invention to provide an improved casement window hinge that will prevent the casement window from becoming misaligned over time.

It is a still further object of the invention to provide a casement window hinge that assists in preventing the casement window from sagging.

It is also an object of the invention to provide a casement window hinge that is resistant to wear and tear over time.

SUMMARY OF THE INVENTION

The casement hinge of the present invention includes a track that may be secured to a casement window frame, a sash arm extending from said track and a support arm that connects the sash arm and the track. On one side or edge of the track there is a rail for retaining a hinge shoe and permitting the shoe to travel along the rail in the track as the window is opened and closed. The sash arm is pivotally mounted at one end thereof on the track by means of a hinge shoe. The hinge shoe is connected to the sash arm by a suitable connection means such as a screw, pin or a rivet. The connection means should permit pivotal movement of the sash arm in relation to the shoe. The sash arm has another connection means which can also be a screw, pin or rivet, that connects the sash arm to the support arm at any one of a number of locations along the sash arm. The multiple connection points increase the adjustability of the hinge to fit any number of casement windows as well as correct minor errors in installation or sagging over time. The connection means joining the sash arm and the support arm should also permit pivotal movement of the two arms. The first shoe is preferably retained in the track to prevent it from becoming separated from the track and the shoe should be able to ride along the track longitudinally as necessary to permit movement of the window.

The first shoe has a plate that has a generally flat portion which is provided with two orifices. The first of these orifices provides a means for connecting the sash arm to the shoe. The second orifice provides a second location for securing the sash arm to the shoe for different windows. Extending upwardly from the top surface of the plate is a ridge or flange that retains the shoe in the rail. On the underside of the plate there are a first rim and a second rim that raise the plate above the track surface so that a rivet or bolt, or pin or screw that is inserted into the either of the two orifices to secure the sash arm to the hinge shoe does not interfere with the travel of the hinge along the track.

One end of the support arm is pivotally connected to the sash arm. The other end of the support arm is connected to a second shoe or gear rack. The second shoe has a fixed position on the track and permits the second end of the support arm to pivot about a pin during opening and closing of the window. In one embodiment of the present invention, the support arm is retained on the pin by a clip. The second shoe is preferably secured to the track through a orifice in the shoe that generally lines up with a orifice in the track by a screw or other means that preferably passes through the track orifice and enters the window frame. Preferably, the orifice or slot is oblong i.e., a relatively long narrow opening. The longer the slot in the shoe, the greater the amount of adjustability that is possible along the track of the hinge. This shape permits the shoe to be adjusted longitudinally. The screw will also provide further anchoring of the hinge to the window frame. The shoe has a recessed base section that has the orifice for securing the shoe to the track. There is also a second orifice that receives a rivet for pivotally securing the support arm to the shoe. Adjacent the recessed base section there may be a raised ledge. On the side of the ledge that is opposite the recessed base section there is a tongue that is provided with a plurality of teeth. Running along the rear of the shoe is a ridge or flange that helps retains the second hinge shoe to the rail. The gear wheel is rotatably secured to the track by a rivet. The rivet is preferably slotted in some manner to permit a screw driver or other type of driver to turn the gear wheel. The teeth on the wheel mesh with the teeth on the tongue and as the gear wheel is turned the tongue is moved in a longitudinal direction along the track. This permits the second shoe to be adjusted to increase the flexibility of the hinge of the present invention in many applications. In particular, the adjustability of the second shoe increases the ease of installation, reduces the effects of sagging in the window and reduces the effects of wear and tear on the components of the hinge over time.

BRIEF DESCRIPTION OF THE DRAWINGS

FIG. 11 is a side view of the hinge shoe of FIG. 10.

FIG. 13 is a view of the underside of the hinge shoe of FIG. 10.

DETAILED DESCRIPTION OF THE INVENTION

Figure 1A:
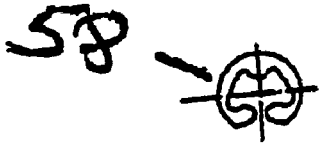
FIG. 1A is a top view of a clip used in the present invention.
Figure 1:
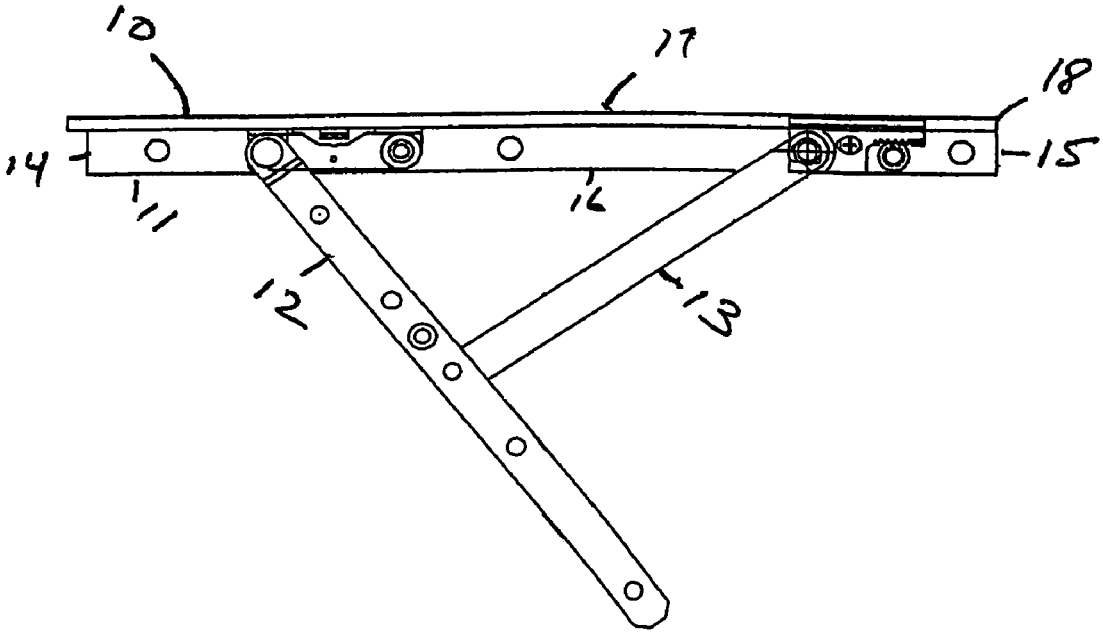
FIG. 1 is a top view of the hinge of the present invention.
Figure 2:
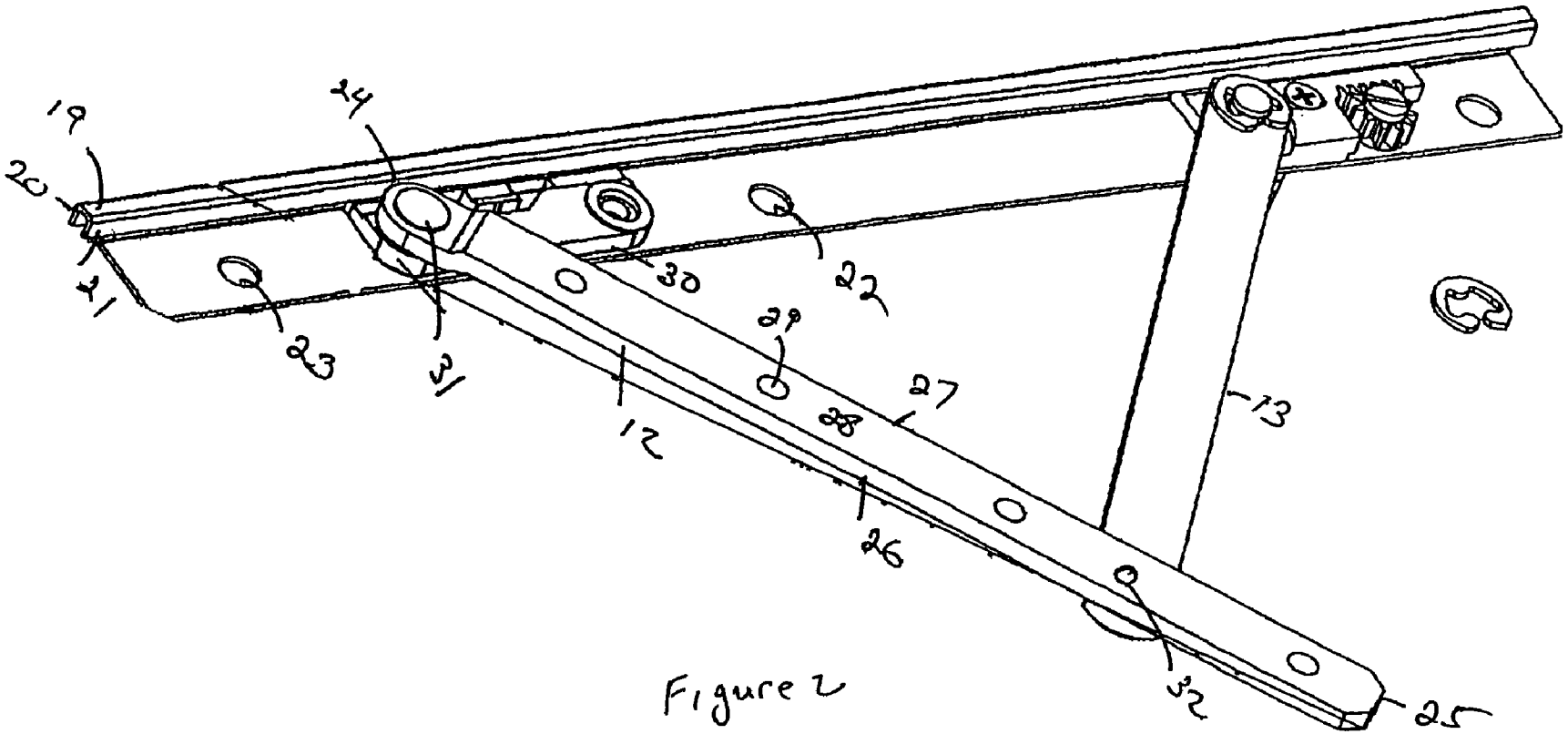
FIG. 2 is a perspective view of the hinge of FIG. 1.
Figure 3:
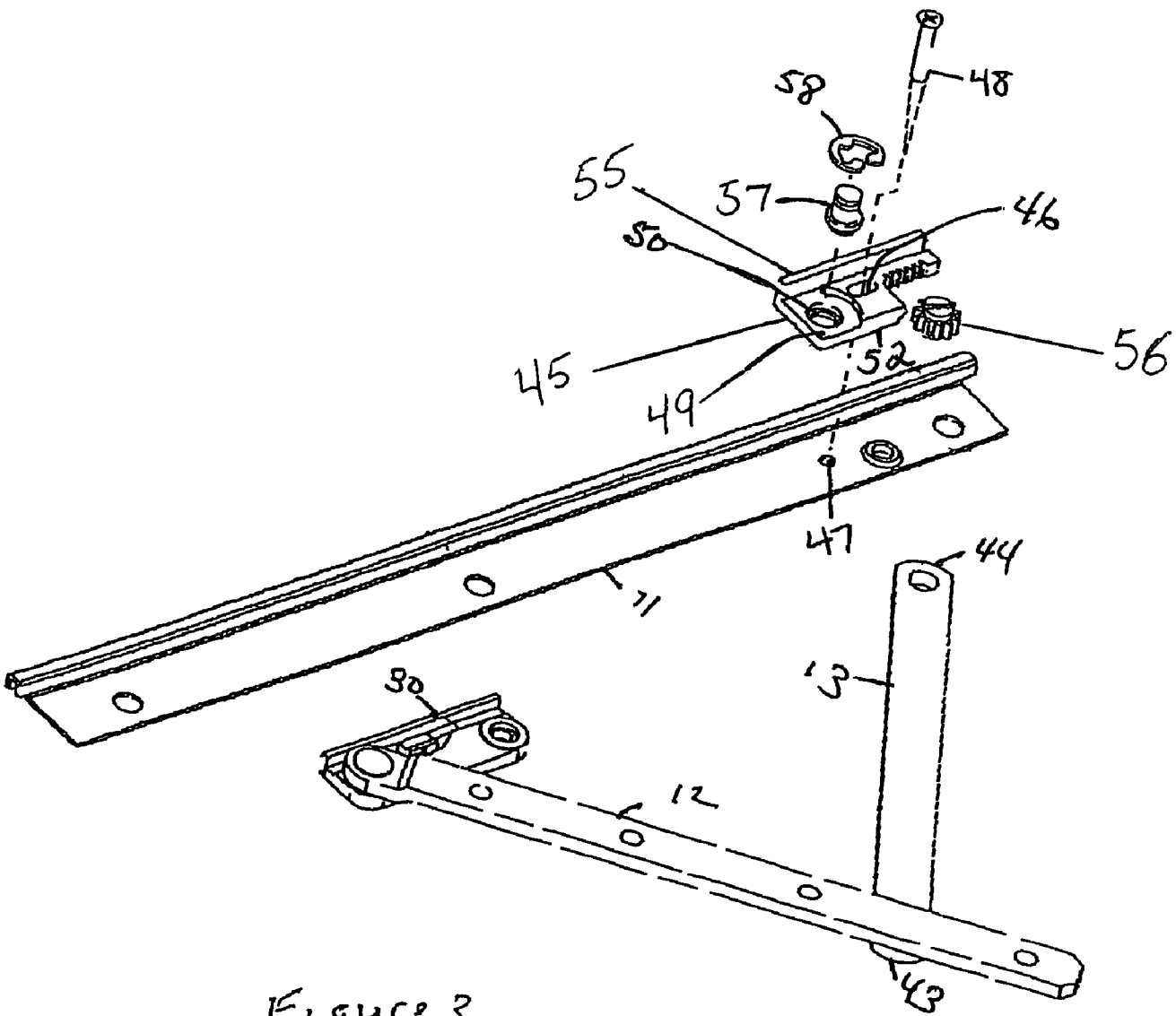
FIG. 3 is an exploded view of the hinge of FIG. 1.

A preferred embodiment of the casement hinge 10 of the present invention is shown in FIG. 1. The hinge includes a track 11, a sash arm 12 and a support arm 13. The track 11 is preferably a generally rectangular sheet of metal or plastic having a first end 14 and a second end 15. The ends are joined together by a first side 16 and a second side 17. Second side 17 preferably is provided with a rail 18 for retaining the hinge shoe and permitting it to travel along the rail in the track 11. The rail may be any suitable means to retain the shoe and permit it to ride along the rail. As seen in FIG. 2, the rail has a rail top member 19, and rail side members 20 and 21. The rail side member 21 may be adhered to the track by any suitable means such as welding or it may be integral with the track. The track is provided with one or more orifices 22 and 23 that enable the track to be secured to the frame of the casement window by screws or other fastening devices.

Extending from the track is sash arm 12. The sash arm 12 has a first end 24 and a second end 25 and a pair of sidewalls 26 and 27 joining the top and bottom surfaces of the sash arm. The top surface 28 of the sash arm has a number of orifices 29 that extend through the arm to the underside of the sash arm 12. These orifices are for mounting the sash arm to a window sash (not shown) through the use of screws that retain the sash arm on the window frame. At the first end 24 of the sash arm 12 there is a first shoe 30 that is connected to the sash arm by a suitable means such as a screw or a rivet 31. The connection means 31 should permit pivotal movement of the sash arm in relation to the shoe. The sash arm 12 has another connection means 32 which can also be a screw or a rivet that connects the sash arm to the support arm 13 at any one of a number of orifices 29 in the sash arm 12. The location of the connection means 32 along the sash arm for connection of the sash arm and the support arm 13 can vary depending on the type of window and the amount the window is intended to be opened. The connection means 32 joining the sash arm 12 and the support arm 13 should also permit pivotal movement of the two arms. The first shoe 30 is preferably retained in the track to prevent it from becoming separated from the track and the shoe should be able to ride along the track longitudinally as necessary to permit movement of the window.

Figure 4:
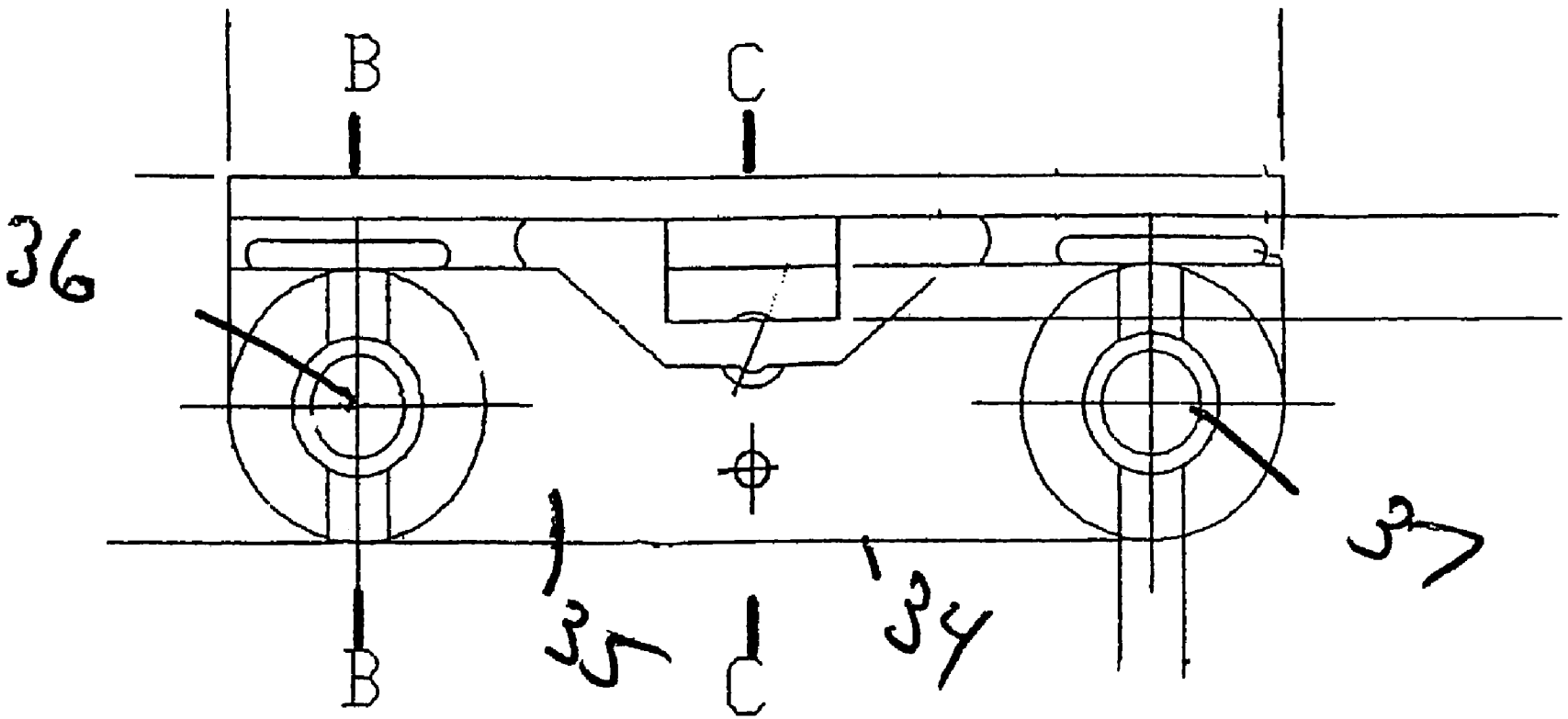
FIG. 4 is a top view of a hinge shoe of the hinge of FIG. 1.
Figure 9:
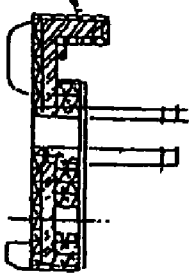
FIG. 9 is a view of the hinge shoe of FIG. 4 taken along C-C.
Figure 8:
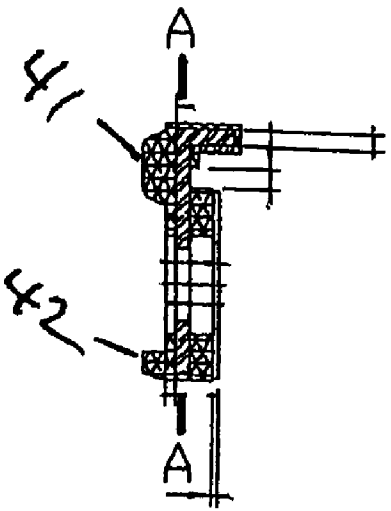
FIG. 8 is an end view of the hinge shoe of FIG. 4 taken along B-B of FIG. 4.
Figure 5:
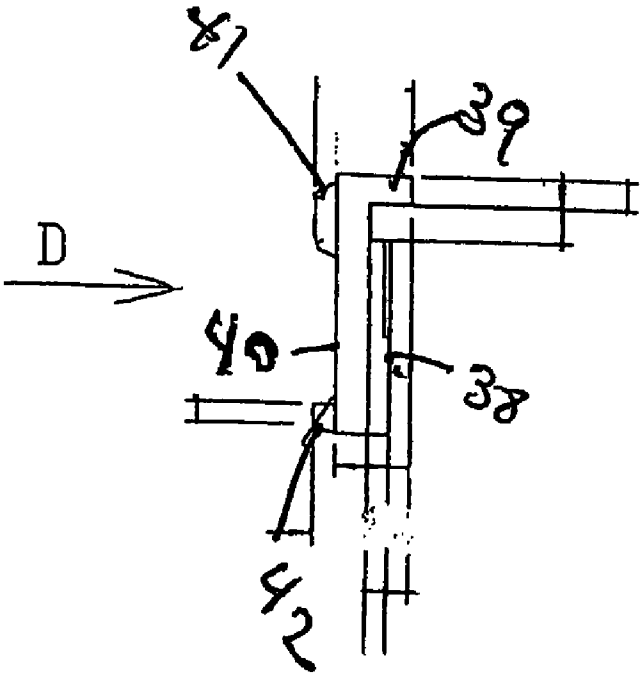
FIG. 5 is an end view of the hinge shoe of FIG. 4.
Figure 7:
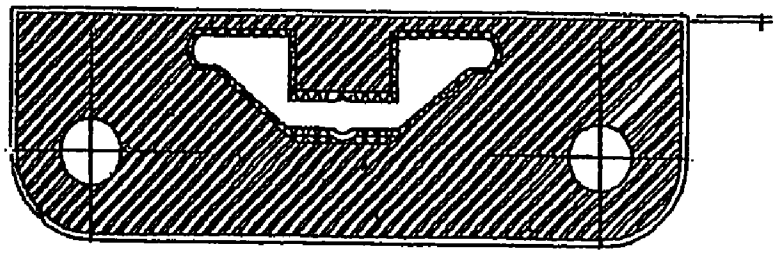
FIG. 7 is a view of the hinge shoe of FIG. 4 taken along A-A.
Figure 6:
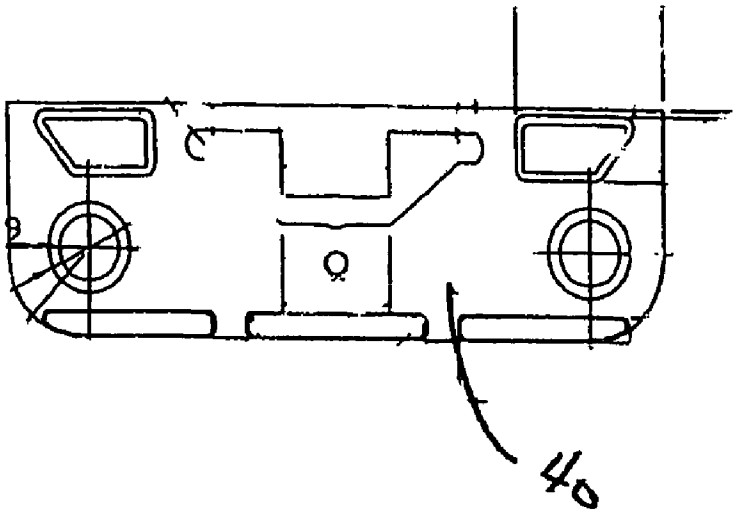
FIG. 6 is a view of the underside of the hinge shoe of FIG. 4.
Figure 14:
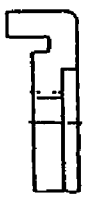
FIG. 14 is another end view of the hinge shoe of FIG. 10 taken from the right side of the shoe.
Figure 12:
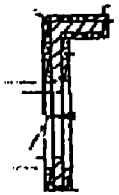
FIG. 12 is an end view of the hinge shoe of FIG. 10.

As seen in FIG. 4 the first shoe 30 has a plate 34 that has a generally flat portion 35, which is provided with a first orifice 36 and a second orifice 37. The first of these orifices 36 provides a means for connecting the sash arm 12 to the shoe. The second orifice 37 provides a second location for securing the sash arm to the shoe for different windows. Thus, the manufacturer can use the same hinge for a number of different window types because of the built-in variations in the hinge. These variations include the first orifice 36 and second orifice 37 in the first shoe 30 for securing the sash arm 12 as well as the plurality of orifices 29 in the sash arm 12 where the support arm may be secured. Extending upwardly from the top surface 38 of the plate 34 is a ridge or flange 39 that retains the shoe in the rail 18. On the underside 40 of the plate 34 there are a first rim 41 and a second rim 42 that raise the plate above the track surface so that a rivet or bolt or screw that is inserted into the either of the two orifices 36 or 37 to secure the sash arm 12 to the hinge shoe 30 does not interfere with the travel of the hinge along the track.

One end 43 of the support arm 13, as noted above, is pivotally connected to the sash arm 12. The other end 44 of the support arm is connected to a second shoe or gear rack 45. The second shoe has a generally fixed position on the track and permits the second end 44 of the support arm 13 to pivot about a pin 57 during opening and closing of the window. In one embodiment of the present invention, the support arm is retained on the pin 57 by removable clip 58. In another embodiment, the clip, a sliding clip, rides along the support arm and engages with the pin. This preferred clip has a first arm and a second arm that are shaped to encircle the pin. The arms are connected by a flat base portion that extends from the arms. At one side of the base portion, there is a first flange extending downwardly from the base portion and a second flange extending from the opposite side of the base portion. Extending inwardly from the bottom edge of each of the flanges is a retaining means. In operation, the arm is received by the area formed by the underside of the base portion, the flanges and the retaining means. If this embodiment is used, a slot may be cut into the support arm to allow the clip to move between two positions, fixed and unfixed. The sliding clip permits the arm to be released for ease of installation of the window without risking the loss of the clip.

Figure 10:
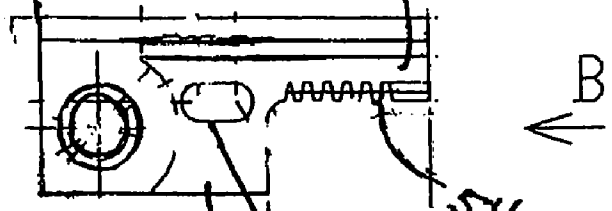
FIG. 10 is a top view of the second hinge shoe of the hinge of FIG. 1.
Figure 15:
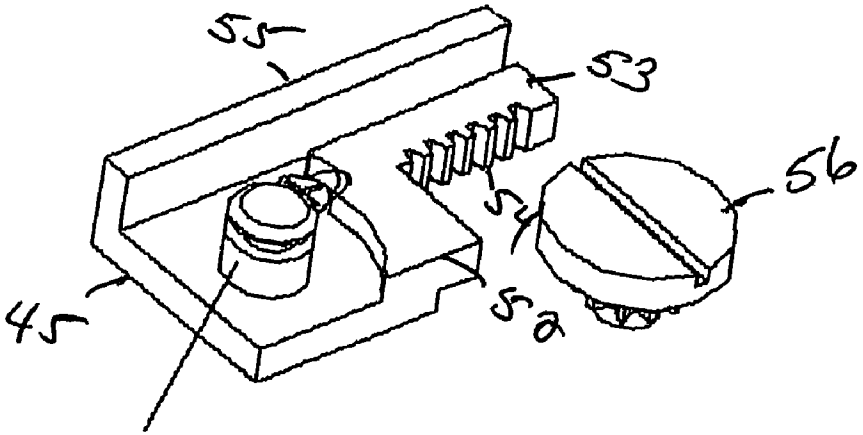
FIG. 15 is a side top perspective view of the gear rack of the shoe of FIG. 10.
Figure 16:
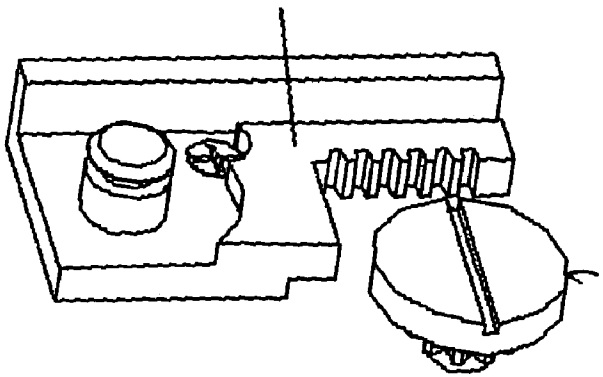
FIG. 16 is front perspective view of the gear rack of the shoe of FIG. 10.
Figure 17:
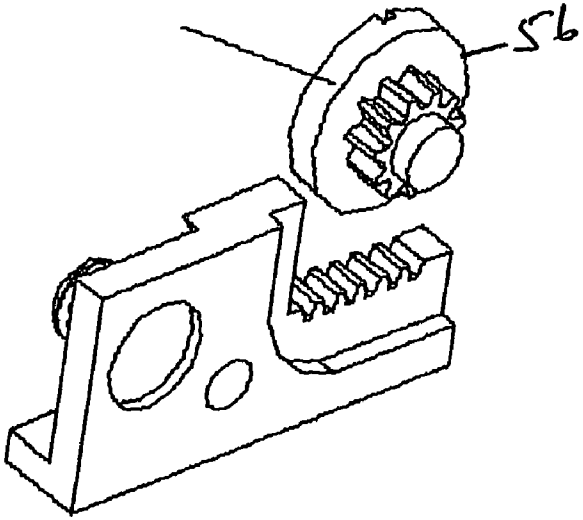
FIG. 17 is underside perspective view of the gear rack of the shoe of FIG. 10.

The second shoe 45 is preferable secured to the track 11 through an orifice 46 in the shoe that generally lines up with a orifice 47 in the track by a screw 48 or other means that preferably passes through the track orifice and enters the window frame. Preferably, the orifice or slot 46 is oblong as shown in FIG. 10. The longer the slot in the shoe, the greater the amount of adjustability that is possible along the track of the hinge. This shape permits the shoe to be adjusted longitudinally in the event the casement hinge needs to be adjusted. This screw will also provide further anchoring of the hinge to the window frame. The shoe has a recessed base section 49 that has the orifice 46 for securing the shoe to the track. There is also a second orifice 50 that receives a rivet or pin 57 for pivotally securing the support arm 13 to the shoe. Adjacent the recessed base section 49 there is preferably a raised ledge 52 that provides additional strength to the shoe. On the side of the ledge 52 that is opposite the recessed base section 49 there is a tongue 53 that is provided with a plurality of teeth 54. Running along the rear of the shoe is a ridge or flange 55 that helps retains the second hinge shoe 45 to the rail 18. Gear wheel 56 may be rotatably secured to the track by a rivet. The gear wheel 56 has a head 59, which is preferably slotted in some manner to permit a screw driver or other type of driver to turn the gear wheel. The teeth on the wheel mesh with the teeth on the tongue 53 and as the gear wheel is turned the tongue is moved in a longitudinal direction within the slot 46. The teeth on the gear wheel and the shoe permit the shoe to be adjusted over a wider range of locations then has heretofore been possible with the prior art hinges.

We claim:

1. An improved hinge for casement windows said hinge comprising:

a track; and a first shoe that is adapted to travel along said track; and a sash arm being pivotally connected and extending from said first shoe; and a second shoe, said second shoe having a tongue extending therefrom said tongue having a series of teeth thereon, said second shoe also being located on said track; and a support arm said support arm having a first end and a second end said first end being pivotally connected to said second shoe and said second end of said support arm being pivotally connected to the sash arm; and a toothed member, said toothed member mating with the teeth on said tongue and allowing said second shoe to be adjusted longitudinally along said track; and wherein said second shoe has a slot that has a means for securing said shoe to said track passing through said track and wherein rotation of said gear causes second shoe to move said slot in relation to said securing means.

2. The improved hinge according to claim 1 wherein said second shoe is secured to the track through a slot in the shoe that generally lines up with said slot in the track by a screw that preferably passes through the track slot.

3. The improved hinge according to claim 2 wherein said slot is oblong.

4. The improved hinge according to claim 3 wherein said base member has an orifice for securing the second shoe to the support arm wherein said orifice is sized and shaped to receive a securing means said securing means connecting said support arm to said base.

5. The improved hinge according to claim 4 wherein said base has a recessed section.

6. The improved hinge according to claim 5 wherein said second shoe has a ridge that retains the shoe to the rail.

7. The improved hinge according to claim 6 wherein said gear is slotted to permit a driver to turn the gear.

8. The improved hinge according to claim 5 wherein adjacent to the recessed base section there is preferably a raised ledge that provides additional strength to the shoe.

9. An improved shoe for a casement window hinge said shoe comprising: a base, said base having a front end and a rear end and two sides, said base having a ridge on said rear end for securing said base to a track and a tongue extending from one of said sides, said tongue having a plurality of teeth extending from a side of said tongue, said teeth defining at least a portion of an outside wall of said tongue a gear wheel adapted to being rotatably secured to a track, said gear wheel having a plurality of teeth about its circumference which mesh with the teeth on said tongue, and wherein rotation of said gear wheel causes the base of said shoe to move longitudinally in relation to said track.

10. An improved hinge for casement windows said hinge comprising:

a track; and a first shoe that is adapted to travel along said track; and a sash arm being pivotally connected and extending from said first shoe; and a second shoe, said second shoe having a base, said base member having a tongue extending therefrom, said tongue having a series of teeth thereon, said teeth defining an outside wall of said tongue, said second shoe also being located on said track; and a support arm said support arm having a first end and a second end said first end being pivotally connected to said second shoe and said second end of said support arm being pivotally connected to the sash arm; and a toothed member, said toothed member is a rotatable gear having teeth that mesh with the teeth on said tongue, and wherein the rotation of said rotatable gear causes the second shoe to move longitudinally with respect to said track; and wherein said base member has a slot that has a means for securing said shoe to said track passing through said track and wherein rotation of said gear causes second shoe to move said slot in relation to said securing means.

11. The improved hinge according to claim 10 wherein said base has a recessed portion said recessed portion having a front edge, a rear edge, a side edge and an arcuate sidewall, said rear edge being located adjacent to a flange portion on said second shoe.

12. The improved hinge according to claim 11 wherein said second shoe is secured to the track through a slot in the shoe that generally lines up with said slot in the track.

13. The improved hinge according to claim 12 wherein said slot is oblong.

14. The improved hinge according to claim 13 wherein said base member has an orifice for securing the second shoe to the support arm wherein said orifice is sized and shaped to receive a securing means said securing means connecting said support arm to said base.

15. The improved hinge according to claim 14 wherein adjacent to the recessed base section there is a raised ledge.

16. The improved hinge according to claim 15 wherein said second shoe has a ridge that retains the shoe to the rail.

17. The improved hinge according to claim 16 wherein said gear is slotted to permit a driver to turn the gear.

18. The improved hinge according to claim 17 wherein said securing means further comprises a pin and a clip, said pin being adapted to fit in said orifice of said base.

19. The improved hinge according to claim 18 wherein said ridge extends from one end of said second shoe to an opposite end of said second shoe.

20. The improved hinge according to claim 19 wherein said clip is generally circular in shape with a diameter that is capable of fitting around said pin.

21. The improved hinge according to claim 19 wherein said clip is generally rectangular in shape having a first arm and a second arm that are shaped to encircle said pin, said arms being connected by a flat base portion that extends from each of said arms.

22. The improved hinge according to claim 21 wherein at one side of the base portion, there is a first flange extending downwardly from the base portion and a second flange extending from the opposite side of the base portion, extending inwardly from a bottom edge of each of the flanges is a retaining means that rides along the support arm.

23. The improved hinge according to claim 22 wherein said support arm has a slot located therein said slot allowing said clip to move from a first fixed position to a second unfixed position.

* * * * *